US005727906A

United States Patent [19]

Nuckols et al.

[11] Patent Number: 5,727,906

[45] Date of Patent: Mar. 17, 1998

[54] HEATED SHELTER FOR DIVER DECOMPRESSION

[75] Inventors: M. L. Nuckols, Annapolis, Md.; Billy Courson, Panama City Beach, Fla.

[73] Assignee: The United States of America as represented by the Secretary of the Navy, Washington, D.C.

[21] Appl. No.: 649,863

[22] Filed: May 10, 1996

[51] Int. Cl.[6] ..... B63C 11/02

[52] U.S. Cl. ..... 405/186; 126/204; 128/205.26

[58] Field of Search ..... 405/185, 186; 126/204, 208; 128/202.12, 205.26

[56] References Cited

U.S. PATENT DOCUMENTS

| | | | |
|---|---|---|---|
| 3,367,319 | 2/1968 | Carter | 126/204 |
| 3,729,002 | 4/1973 | Miller | 128/204 |
| 3,815,573 | 6/1974 | Marcus | 126/204 |
| 4,011,867 | 3/1977 | Arntzen | 405/185 X |
| 4,067,064 | 1/1978 | Ceniway et al. | 126/204 X |
| 4,106,504 | 8/1978 | Yark | 128/204 |
| 4,111,313 | 9/1978 | Reiher et al. | 405/185 X |
| 4,195,949 | 4/1980 | Reiher | 405/185 |
| 4,208,152 | 6/1980 | Colston | 405/186 |
| 4,227,524 | 10/1980 | Galerne | 128/205.26 |
| 4,294,225 | 10/1981 | Mayo | 126/204 |
| 4,338,267 | 7/1982 | Riuli et al. | 128/200.11 X |
| 4,390,305 | 6/1983 | Sloan | 405/186 |
| 5,100,261 | 3/1992 | Plemon | 405/186 |
| 5,255,673 | 10/1993 | Cardwell et al. | 128/202.12 |
| 5,421,340 | 6/1995 | Stanga et al. | 128/671 |
| 5,467,764 | 11/1995 | Gamow | 128/202.12 |

*Primary Examiner*—Dennis L. Taylor
*Attorney, Agent, or Firm*—Harvey A. Gilbert; William C. Townsend

[57] ABSTRACT

A heated decompression shelter for use by a diver underwater during decompression at the end of a cold water dive. The heated decompression chamber provides a micro-environment within an enclosure for thermal protection during decompression stops in cold water, some of which can be of relatively long duration following relatively deep dives in near freezing water.

31 Claims, 7 Drawing Sheets

HEATED SHELTER FOR DIVER DECOMPRESSION

BACKGROUND OF THE INVENTION

The present invention relates in general to decompression chambers used by underwater divers and pertains, more particularly, to a heated shelter capable of maintaining a suitable micro-environment around the outside of a conventional diver's suit during relatively long decompression stops during cold water (near 29°–34° F.) dives. The heated diver decompression shelter invention is a significant improvement over either conventional active or passive thermal protection systems.

The Navy Dive Manual (1987), for example, specifies that at the completion of a twenty minute exposure at a three-hundred foot depth, a diver breathing a helium-oxygen mixture should ascend to a one-hundred fifty foot depth to begin decompression with subsequent stops at ten-foot intervals. The initial decompression stops are relatively short in duration, but become progressively longer after arriving at the one-hundred foot depth to eventually total nearly five hours of decompression before the diver reaches the surface after a dive of three hundred feet.

During these long decompression stops the diver experiences low metabolic heat production which can be potentially life threatening in near freezing water temperatures without a supplemental thermal protection system. Active and passive methods of thermally protecting divers during long, cold-water (near freezing) missions have been sought since man first began to work in and explore the seas.

Conventional active thermal protection systems utilize heat distribution garments, such as tubesuits, which are typically worn beneath either insulated dry diving suits or loose-fitting hot water suits. These heat distribution garments utilize hot water (e.g. approximately 100° F.) which is pumped inside the garment to compensate for heat losses from the diver's body when surrounded by cold water.

Drawbacks to the conventional thermal protection systems include restricted mobility during the period of the dive which can hinder the diver's performance, large heater capacity requirements which restrict remote dives where only minimal surface support is available, potential for burning the diver with the hot water, and a lack of thermal protection to the diver's breathing apparatus. The effect of thermal protection with respect to the diver's breathing apparatus is discussed in the following paragraph.

Another drawback is the temperature dependency of the carbon dioxide scrubber of a diver's closed circuit breathing apparatus (such as the U.S. Navy's MK16). As such, the scrubber provides less re-breathing capability at lower temperatures, resulting in shorter mission durations in colder water as compared to missions performed in higher water temperatures.

Conventional passive thermal protection systems rely on insulation to reduce the amount of heat lost from the diver's body. Typically, passive thermal protection systems utilize thick, layered insulating garments worn beneath waterproof diving suits to reduce the loss of body heat to the surrounding cold water.

These suits are excessively buoyant, bulky, and difficult to keep waterproof. Additionally, the suits are not very effective in protecting a diver's extremities especially during longer duration dives.

Even a current state-of-the-art drysuit will only allow mission durations of two hours or less in near freezing temperatures. As such, all of the foregoing conventional alternatives are undesirable from a performance and a reliability standpoint.

SUMMARY OF THE INVENTION

Accordingly, it is an object of the present invention to provide a heated decompression shelter which is effective in protecting a diver, including the diver's extremities, during relatively long cold water decompression stops.

Another object of the present invention is to provide a heated decompression shelter which is capable of maintaining a 50° F.–60° F. micro-environment around the outside of a diver's conventional suit thereby allowing mission durations in excess of six hours in 29° F.–34° F. water temperatures.

A further object of the present invention is to provide a heated decompression shelter which utilizes a relatively small heating source which is deployable from a small surface boat.

Still another object of the present invention is to provide a heated decompression shelter which can be deployed at relatively remote dive sights.

Still a further object of the present invention is to provide a heated decompression shelter which can be utilized by more than one diver during a mission.

Another object of the present invention is to provide thermal protection for the temperature dependent carbon dioxide scrubber of a diver's closed circuit breathing apparatus thereby allowing dives of increased duration.

To accomplish the foregoing and other objects of this invention there is provided a heated decompression shelter capable of maintaining a suitable micro-environment around the outside of a conventional diver's suit during decompression stops in cold water (29° F.–34° F.) dives. The heated decompression shelter of this invention offers a reliable, low cost alternative for diver thermal protection in extreme cold water diving.

The heated decompression shelter accomplishes these objects by creating an artificial womb around the diver with its own, temperature controlled micro-environment within the chamber of the shelter. Even in near freezing ambient temperatures, the trapped, relatively warm water inside the shelter will create a safe, tolerable environment for the diver during decompression, including thermal protection for his hands and feet.

The relatively warm micro-environment temperatures of this heated decompression shelter are capable of being established and maintained with a relatively small conventional heat source, such as an outboard engine, having a circulating water pump with a water inlet and a water outlet. This easily controlled heating source is used to establish, and maintain, the desired micro-environment temperature within the decompression shelter.

The presently preferred embodiments of the present invention disclose two approaches to constructing the shelter. One approach is to construct the shelter as a cocoon to enclose one or more divers by using a thin, clear baggie-like member with an elastic opening at its bottom for diver entry and a Ziplock® style closure at the top to provide an emergency exit.

A second preferred approach is to construct the shelter in the form of thin-walled coveralls which could be donned individually by divers upon arriving at their decompression stops. This second approach would give the same effect as the baggie-type construction by providing the micro-environment while minimizing the warm water required within the shelter.

In either approach, the heated decompression shelter comprises an enclosure capable of sheltering one or more divers and a first flexible tube having a first end and a second end. The enclosure comprises at least one inlet for receiving pre-heated water, at least one outlet for discharging the pre-heated water, and a first opening capable of being closed or at least effectively closed to separate the micro-environment created within the enclosure from the exterior, hostile environment.

The first end of the first flexible tube is removably connected to the water outlet of the circulating water pump of the relatively small conventional heat source, and the second end of the first flexible tube is removably connected to at least one inlet of the enclosure. In an alternative preferred embodiment, the heated decompression shelter comprises a thin wall clothing garment, such as coveralls, and a first flexible tube having a first end and a second end.

The thin wall clothing garment comprises at least one inlet for receiving pre-heated water and at least one outlet for discharging the pre-heated water. The first end of the first flexible tube is removably connected to the water outlet of the circulating water pump of the relatively small conventional heat source, and the second end of the first flexible tube is removably connected to at least one inlet of the thin wall clothing garment.

Other variations of the heated decompression shelter include a second flexible tube having a first end and a second end. The first end of the second flexible tube is removably connected to the inlet of the circulating water pump and the second end of the second flexible tube is removably connected to at least one outlet of either the enclosure of the preferred embodiment or the thin wall clothing garment of the alternate embodiment so as to provide for recirculating the heated water within the micro-environment of the enclosure.

The heated decompression shelter can be manufactured of different materials, sizes and colors. In both the preferred and alternate embodiments described herein the heated decompression shelter comprises a substantially waterproof flexible material.

BRIEF DESCRIPTION OF THE DRAWINGS

Numerous other objects, features and advantages of the invention should now become apparent upon a reading of the following detailed description taken in conjunction with the accompanying drawings, in which.

DETAILED DESCRIPTION

Figure 1:
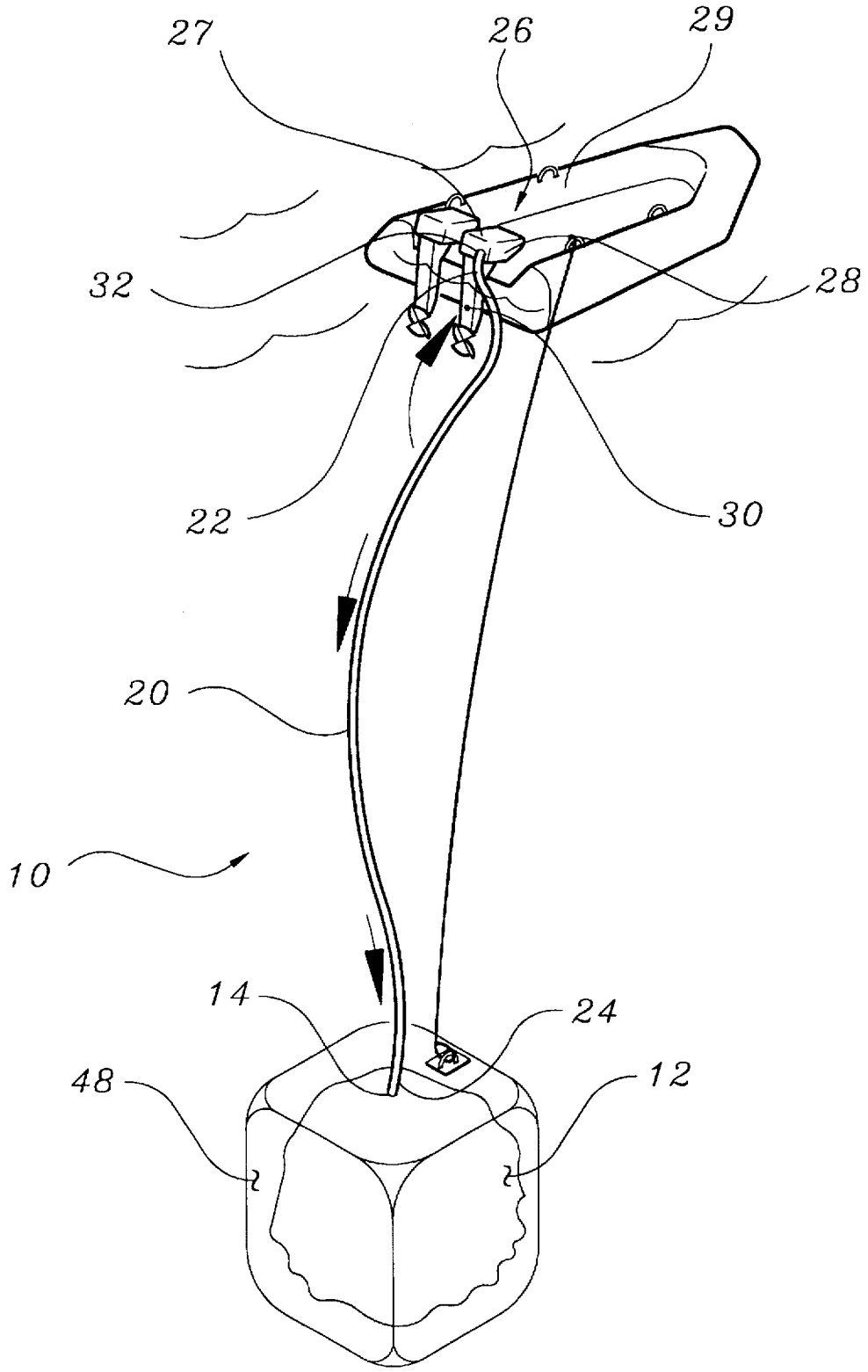
FIG. 1 is a perspective view of a preferred embodiment of the heated decompression shelter shown having a first flexible tube attached to a relatively small surface heat source.
Figure 2:
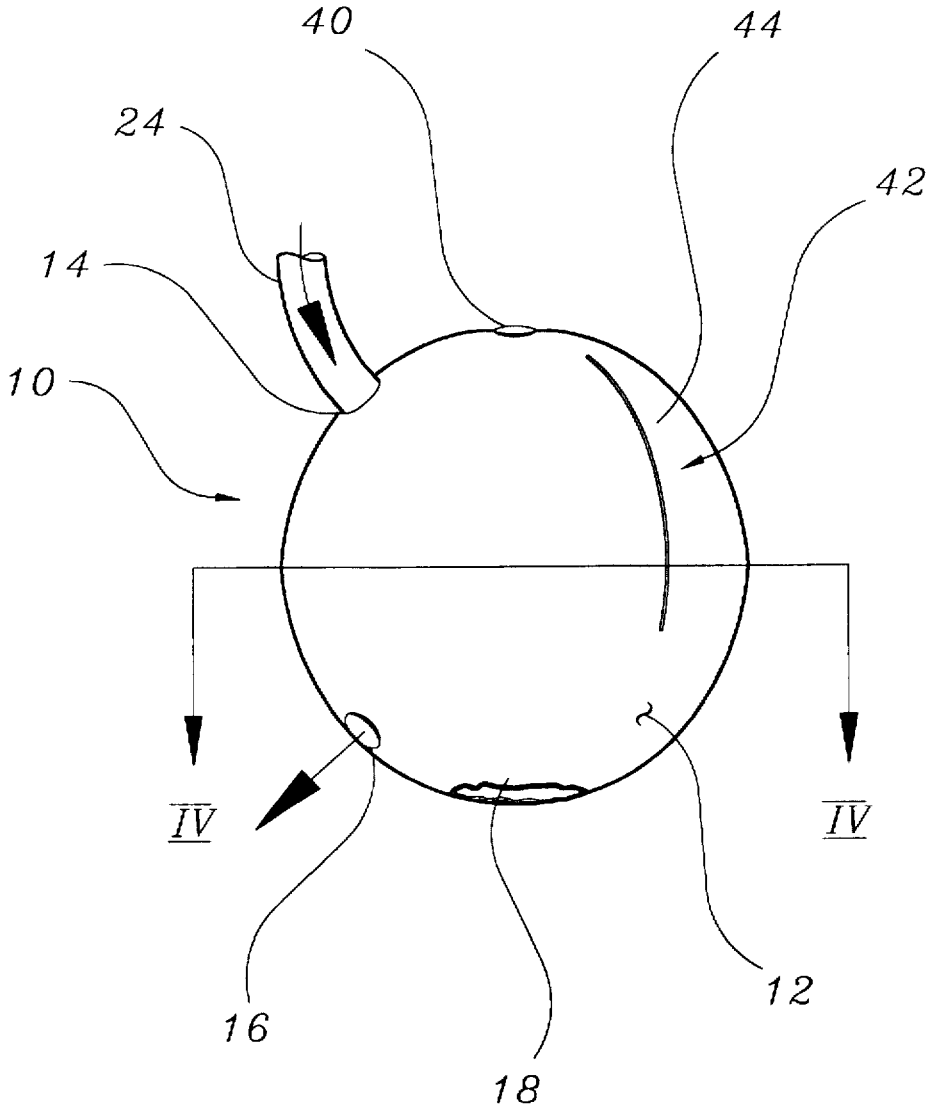
FIG. 2 is a side view of the preferred embodiment of the heated decompression shelter.
Figure 3:
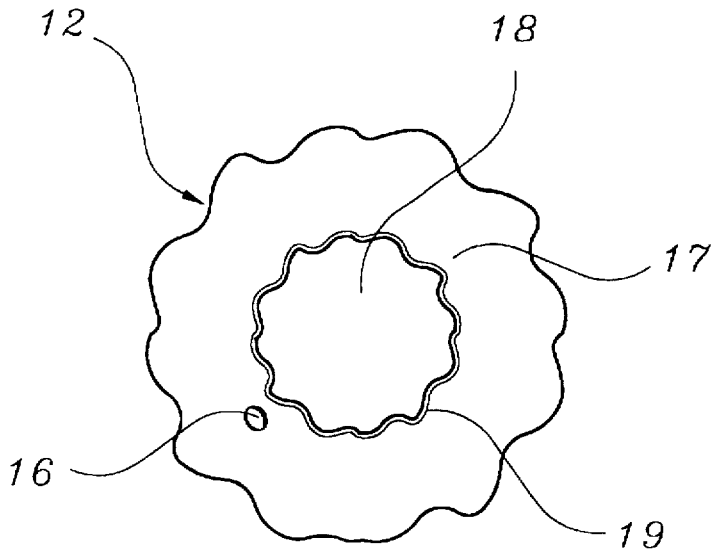
FIG. 3 is a bottom view of the preferred embodiment of the heated decompression shelter.
Figure 4:
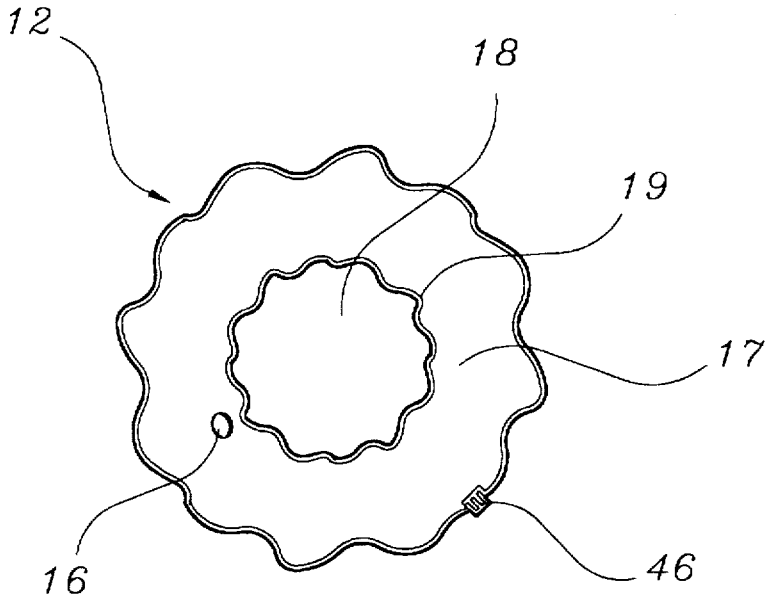
FIG. 4 is a cross-sectional view of the preferred embodiment shown in FIG. 2 of the heated decompression shelter illustrating the closure mechanisms of the openings.
Figure 5:
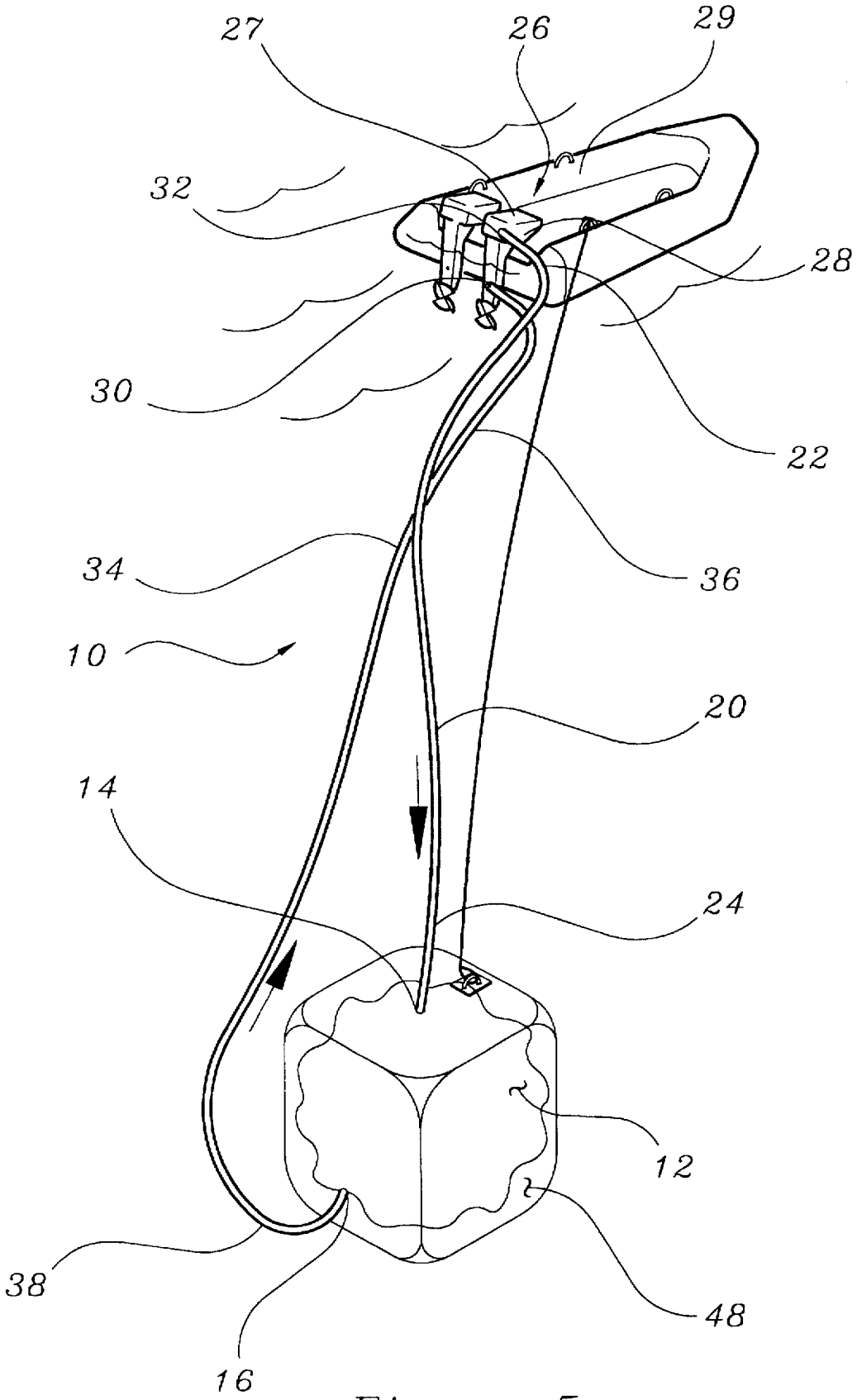
FIG. 5 is a perspective view of another variation of the preferred embodiment of the decompression shelter shown having both a first flexible tube and a second flexible tube attached to a relatively small surface heat source.

Referring now to the drawings there is shown a preferred embodiment of the heated decompression shelter in FIGS. 1–5. The drawings show the decompression shelter 10 in conjunction with a relatively small conventional heat source 26 having a circulating water pump 28 with a water inlet 30 and a water outlet 32.

Preferably, the relatively small conventional heat source 26 comprises an outboard engine 27 attached to a diver's small surface-support boat 29. Typically wasted exhaust coolant water, generated as the outboard engine 27 idles on the surface, is utilized to warm the decompression shelter 10.

The preferred embodiment of the decompression shelter 10 comprises an enclosure 12 and a first flexible tube 20. The enclosure has at least one warm water inlet 14, at least one warm water outlet 16, a first opening 18 having an edge margin 17 with an elastic fastener 19, a second opening 42 having an edge margin 44 with a tab and groove type fastener 46, such as a Ziplock® brand closure, and a pressure relief valve 40.

The first flexible tube 20 has a first end 22 and a second end 24. The first end 22 is removably connected to the water outlet 32 of the circulating water pump 28 and the second end 24 is removably connected to the at least one inlet 14 of the enclosure 12.

The first opening 18 is large enough to accommodate passage of a diver and is utilized by the diver for entering and exiting the enclosure 12. The first opening 18 is typically located at or near the bottom of the enclosure 12 and typically remains in a substantially closed position.

The first opening 18 is substantially closed by an elastic fastener 19 attached to the edge margin 17 of the first opening 18. The first opening 18 can be easily opened by the diver by pulling or stretching the elastic fastener 19.

The second opening 43 is provided as an emergency exit and is typically, although not necessarily, located near the top or side of the enclosure 12. The second opening 43 is closed by a tab and groove type fastener 46, such as a Ziplock® brand closure, during normal operation.

The pressure relief valve 40 allows pre-heated water to escape the enclosure 12 before sufficient pressure builds up to damage the enclosure 12.

Heat generated by the idling outboard engine 27 is absorbed by the engine cooling water and pumped into the enclosure 12 via the first flexible tube 20. This heated water is substantially contained within the enclosure 12 and continually replenished thereby creating a suitable micro-environment for thermally protecting the diver during relatively long decompression stops.

In the preferred embodiment, the enclosure 12 is comprised of a transparent material to allow for increased visibility. It will be understood that any suitable color or pattern may be applied to the enclosure.

Figure 6:
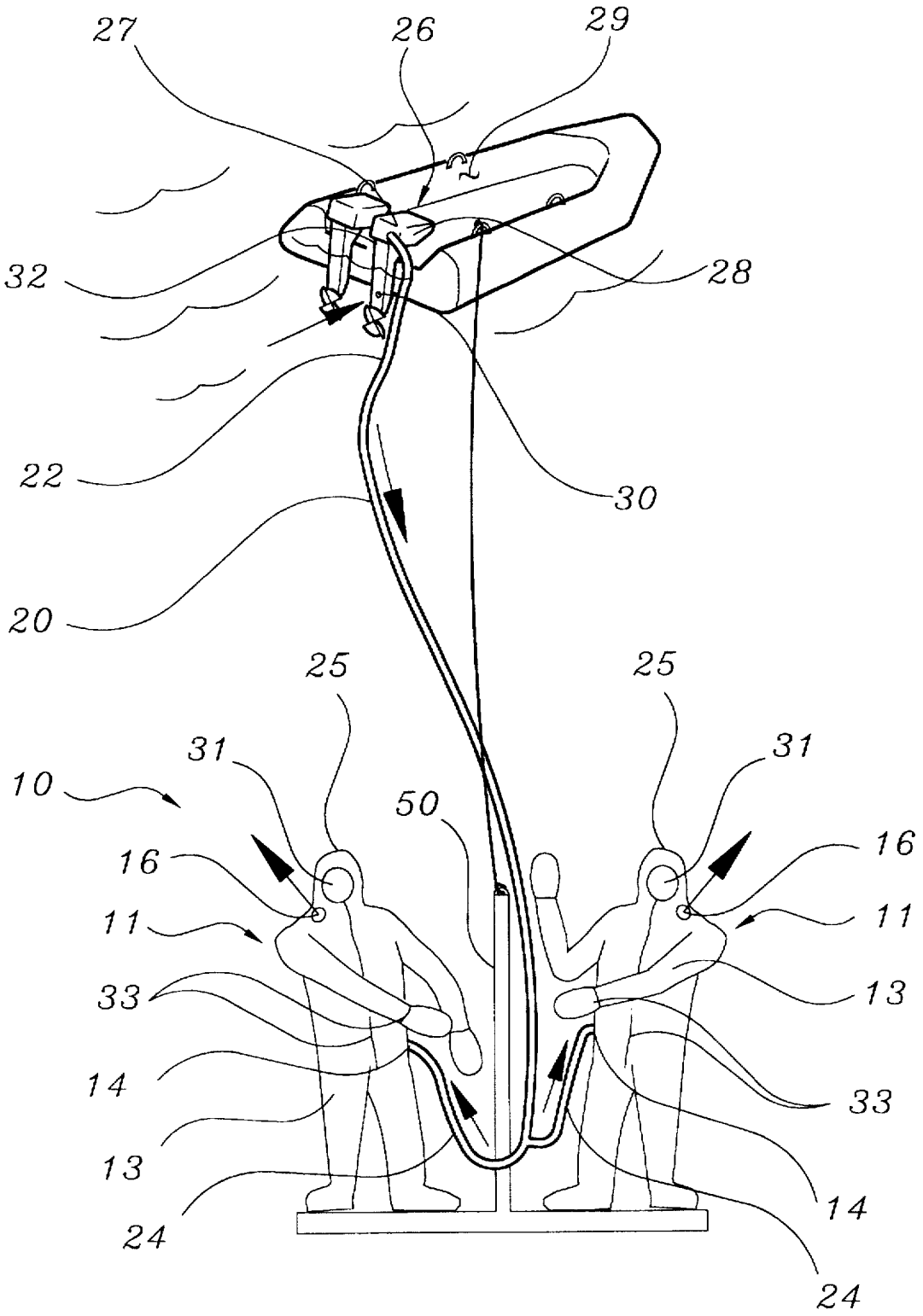
FIG. 6 is a perspective view of an alternate embodiment of the heated decompression shelter shown having a first flexible tube attached to a relatively small surface heat source.
Figure 7:
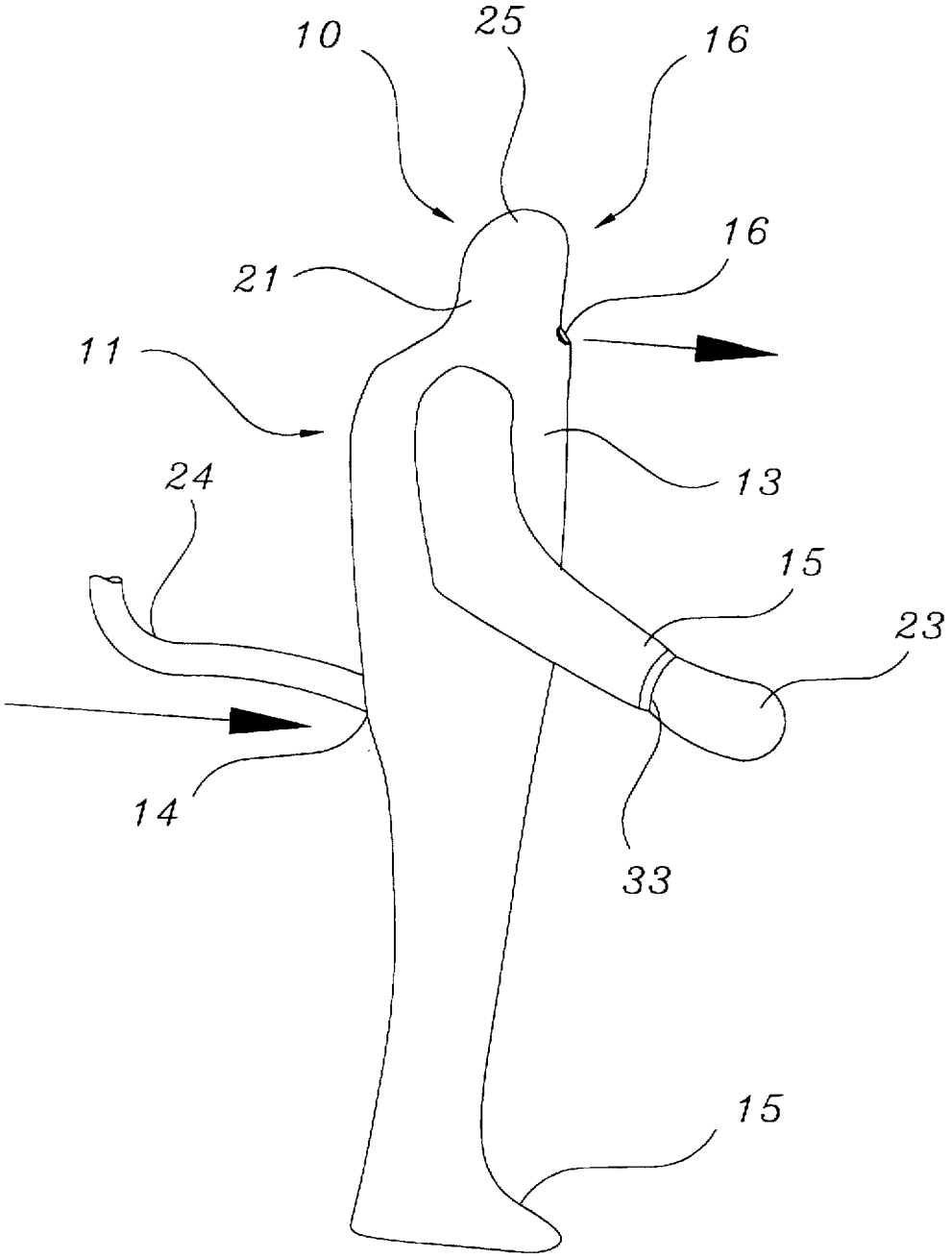
FIG. 7 is a view of the alternate embodiment of the heated decompression shelter.
Figure 8:
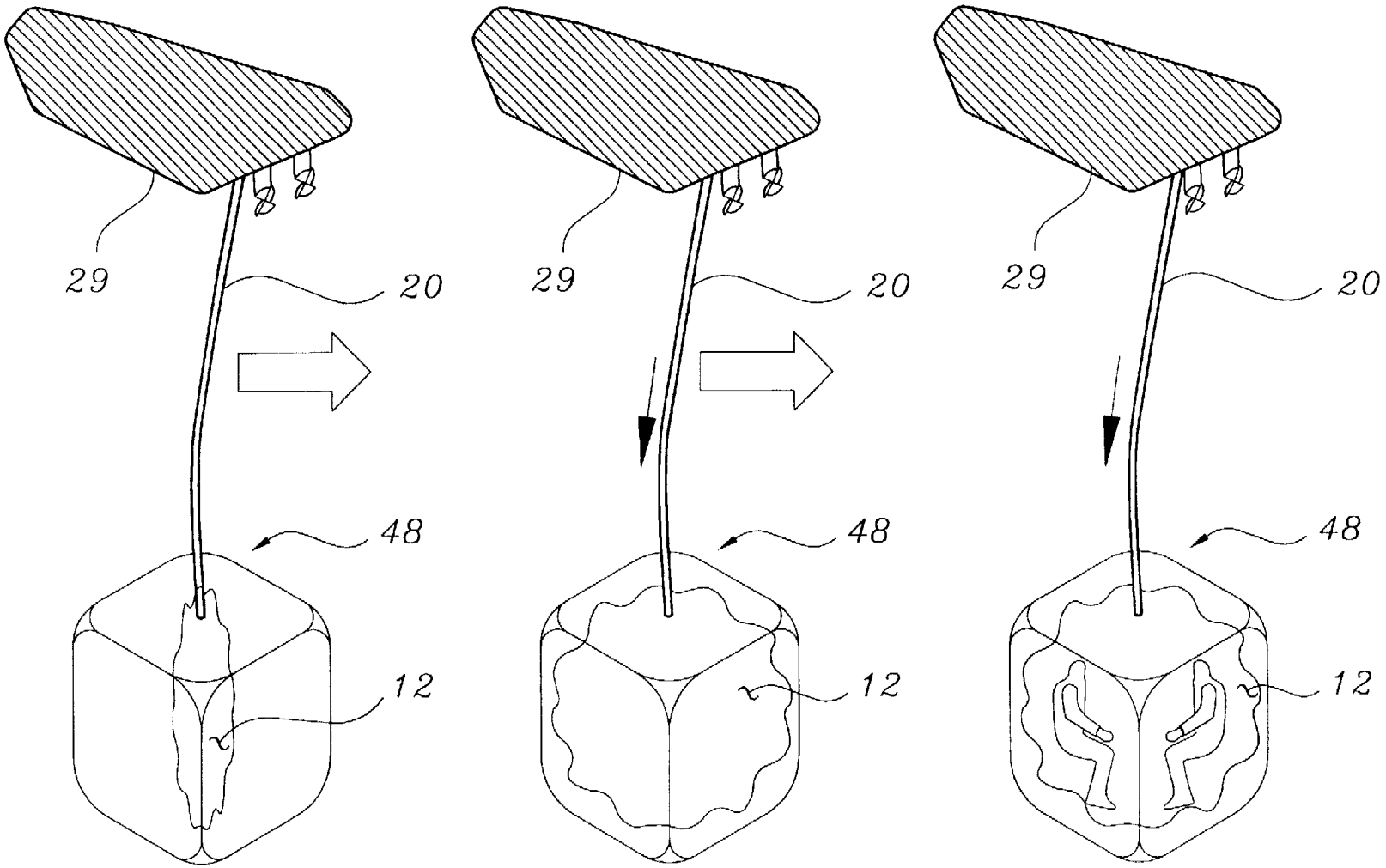
FIG. 8 is a schematic view of the preferred embodiment of the heated decompression shelter shown at the various stages of deployment.

FIGS. 6–8 illustrate an alternate embodiment of the heated decompression shelter. This alternative embodiment comprises a thin-walled clothing garment 11, such as coveralls 13, and a first flexible tube 20.

The thin-walled clothing garment 11 has at least one water inlet 14, and at least one water outlet 16. The first flexible tube 20 has a first end 22 and a second end 24.

The first end 22 is removably connected to the water outlet 32 of the circulating water pump 28. The second end 24 is removably connected to the at least one inlet 14 of the thin-walled clothing garment 11.

The thin-walled clothing garment 11 preferably comprises coveralls 13 having a neck portion 21, extremity portions 15, and hook and loop type fasteners 33 for substantially enclosing the garment around a diver. The coveralls 13 further include a plurality of pockets 23 attached to the extremity portions of the coveralls 11, and a hood 25 having a substantially transparent portion 31 attached to the neck portion 21 of the coveralls 11.

The plurality of pockets 23 provide thermal protection to the extremities of a diver. The hood 25 provides thermal protection for the diver's head without significantly restricting the diver's visibility while wearing the garment.

Additionally, the pressure relief valve 40 may be added to the thin-walled clothing garment 11. The pressure relief valve is utilized to provide protection against damage caused by an undesired pressure buildup within the garment.

When utilizing coveralls with minimal volume, a response time of approximately ten minutes to reach 50° F. could be achieved. This would be the approximate response time if the total shelter volume is limited to approximately 2 cubic feet per coverall.

Another variation of both the preferred and alternate embodiments allows the prewarmed water to be recirculated by utilizing a second flexible tube 34 which has a first end 36 and a second end 38. The first end 36 of the second flexible tube 34 is removably connected to the water inlet 30 of the circulating water pump 28 and the second end 38 of the second flexible tube 34 is removably connected to the at least one outlet 16 of the enclosure 12 or the thin-walled clothing garment 11.

The aforementioned variation minimizes heat losses and, therefore, facilitates maintenance of the desired micro-environment within larger enclosures which can accommodate multiple divers or with multiple divers wearing thin-walled clothing garments all connected to the same heat source.

In both the preferred and the alternative embodiments, the decompression shelter 10 is comprised of a flexible, substantially waterproof material. It will be understood that other types of material could be substituted for the preferred material.

In operation, the enclosure 12 is connected to the circulating water pump 28 of the outboard engine 27. The first end 22 of the first flexible tube 20 is removably connected to the water outlet 32 of the circulating water pump 28.

The second end 24 of the first flexible tube 20 is removably connected to the inlet 14 of the enclosure 12. Then the enclosure 12 is lowered from the small surface support boat 29 in its collapsed or folded state.

Typically, the collapsed or folded enclosure 12 is suspended in a support cage 48 at the first lengthy decompression stop. This is typically at a depth of approximately 100 feet from the water's surface for dives of up to three-hundred (300) feet.

The outboard engine 27 attached to the small surface support boat 29 is started and allowed to idle while the diver(s) performs the mission at a depth greater than one hundred feet below the surface. The diver typically wears only a conventional wet suit while performing the mission so as to not restrict mobility and hinder the mission.

While the outboard engine 27 idles it generates heat which is dissipated through the use of a circulating water pump 28. The heated water is used to warm the enclosure 12 creating a type of artificial womb or micro-environment.

In the preferred embodiment, as the outboard engine 27 idles, cold surface water is continually drawn into the inlet 30 of the circulating water pump 28, where it absorbs heat from the outboard engine 27. The now warmed water is discharged through the outlet 32 of the circulating water pump 28 and into the enclosure 12 through the first flexible tube 20.

The warmed water is conveyed through the flexible tube 20 down to the enclosure 12 where it gradually inflates the enclosure 12 and substantially displaces any cold water which may have entered through the first opening 18. The enclosure 12 is prevented from overinflating and possibly bursting by the use of the pressure relief valve 40 or its equivalent.

It is believed that this preferred embodiment should be capable of maintaining the desired micro-environment within the enclosure. For example, the water temperature inside the enclosure 12 could be maintained at approximately 50°–60° F. with the enclosure suspended in water at a temperature at or near freezing (e.g., 29°–34° F.).

In one variation of this embodiment, a second flexible tube 34 is utilized. The first end 36 of the second flexible tube 34 is removably connected to the inlet 30 of the circulating water pump 28 and the second end 38 of the second flexible tube 34 is removably connected to the at least one outlet 16 of the enclosure 12.

In this particular variation of one preferred embodiment, the warmed water is continually recirculated. The recirculating embodiment allows for greater flexibility in maintaining a desired micro-environment temperature within the enclosure. This variation is preferred for use with larger volume enclosures or when multiple divers are using the enclosure.

Upon completion of the mission, the diver ascends to the first lengthy decompression stop where the enclosure 12 is located. The diver opens the first opening 18 and enters the enclosure 12.

The first opening 18 should be kept closed so far as this is possible. Therefore, in one preferred embodiment, the enclosure is kept substantially closed through the use of an elastic fastener 19 attached to the edge margin 17 of the first opening 18.

The diver remains in the enclosure 12 for the duration of the first and any subsequent decompression stops. In the event of an emergency, the diver can safely egress through the second opening 42 of the enclosure 12.

The edge margin 44 of the second opening 42 has a tab and groove type fastener 46. This tab and groove fastener is used to provide a substantially watertight seal.

The enclosure 12 and corresponding support cage 48 may then be repositioned after the appropriate time to another depth for the next decompression stop. It is anticipated that the enclosure 12 will be repositioned by the surface support crew.

The process of the present invention continues during the decompression cycle as the diver requires. Typically, the process of the present invention continues until the diver(s) decompression is complete and the diver can surface or exit the enclosure.

In one alternative embodiment, the thin-walled clothing garment 11, for example, coveralls 13, provides the micro-environment containing enclosure for the diver. The operation of this embodiment of the present invention is essentially the same as that described above for the enclosure 12.

Typically, the thin-walled clothing garment 11 is lowered from the surface and suspended on a support platform 50. The support platform can also be used to support one or more divers while the garment 11 is connected to the heat source and worn by the diver.

The diver dons the substantially inflated/unfolded coveralls 13 at the first decompression stop. The diver will remain in the coveralls 13 and continue to be supported by the support platform 50 during the first and subsequent decompression stops.

A more detailed example of the operation of this decompression shelter is described in the following paragraphs. In this example, the invention is used to support two divers during a twenty (20) minute dive to a depth of three-hundred (300) feet in 34° F. water using closed circuit scuba gear, such as the U.S. Navy's MK16 underwater breathing apparatus.

The Navy Dive Manual (1987) specifies that at the completion of a twenty (20) minute exposure at three-hundred (300) feet, breathing a helium-oxygen mixture, a diver should ascend to one-hundred and fifty (150) feet to begin decompression followed by stops at ten (10) foot intervals. The initial stops, up to a depth of one-hundred and ten (110) feet are relatively short in duration (e.g., 3–4 minutes).

After rising to a depth of one-hundred (100) feet (the diver should arrive at this depth at approximately forty and one-half (40.5) minutes after leaving the surface), the stops become progressively longer. There will be a total of nearly five (5) hours of decompression before the diver will complete decompression and reach the surface.

Unlike the time spent on the bottom, the decompression time is accompanied by a low metabolic heat production. The lack of sufficient metabolic heat production creates a life-threatening exposure to the diver in 34° F. water unless a supplemental thermal protection system is utilized.

Using the micro-environment enclosure of this invention to shelter the diver, surface support personnel inflate the enclosure or the thin coveralls, with warm seawater supplied by the small surface heater while the divers are conducting and completing their dive instituting the initial decompression stop. The diver returns from the bottom and reaches the one-hundred (100) foot depth stop and begins decompression.

The diver enters the warm micro-environment trapped within the enclosure through the first opening in the bottom of the enclosure or through the Velcro® brand enclosures of the coveralls. The micro-environment within the enclosure will have been warmed by the warm water from the surface that reaches the enclosure by means of the flexible tubing and can be returned to the surface for rewarming in a closed circuit configuration of the present invention.

The enclosure creates a warm thermocline within which the diver can remain during the decompression stops. Additionally, the diver's breathing apparatus is also being bathed within this warm thermocline, resulting in an increased duration for a temperature dependent breathing apparatus (e.g., a carbon dioxide scrubber).

From the foregoing description those skilled in the art will appreciate that all objects of the present invention are realized. A heated enclosure of use during diver decompression to shelter the diver during decompression has been shown and described which is capable of providing a 50°–60° F. micro-environment within the enclosure.

The enclosure of the present invention protects a diver, the diver's extremities, and the diver's breathing apparatus. The preferred embodiments of the present invention should be suitable for mission durations of up to six hours (including mission time and decompression time) in 29°–34° F. water.

The shelter of this invention is primarily intended for use during a mission requiring multiple decompression stops. The design and construction of the present invention is intended to allow for the relatively unrestricted movement of the diver at relatively lower depths or near the bottom in near freezing water.

The low operational temperatures of the enclosure of the present invention should avoid the occurrence of burns to the diver associated with conventional hot water systems. Along with the low temperature operation and elegant construction of the present invention, the enclosure has no need for specialized equipment to support long duration, cold water dives, nor is other than minimal surface support required for the invention to be used by a diver.

The shelter of this invention utilizes only wasted heat from a surface-mounted and relatively small conventional heat source, such as an outboard motor. The outboard motor is economical to operate and can be utilized in substantially remote sites.

The heat recovered from the outboard motor's cooling system is readily available on the diver's support boat and is more than adequate to supply all heating requirements in remote diving locations. Water pumping between the surface and the diver is achieved using the circulating water pump already in operation on the boat's outboard motor.

A small inflatable boat is adequate to support this decompression shelter. Surface support personnel need only to attach tubing to the boat motor cooling system, lower the lightweight shelter and begin supplying warm water as the motor idles.

The preferred design of the present invention, as well as alterations that will now be apparent to those skilled in the art, all allow use of the enclosure in substantially all dives where hypothermia may be an issue and the dive depth and mission time is suitable for using the present invention. The enclosure of this invention is further characterized by its capability to enclose multiple divers.

Having described the invention in detail, those skilled in the art will appreciate that modifications may be made of the invention without departing from its spirit. Therefore, it is not intended that the scope of the invention be limited to the specific embodiments illustrated and described. Rather it is intended that the scope of this invention be determined by the appended claims and their equivalents.

What is claimed is:

1. A collapsible heated diver decompression shelter of flexible material, comprising:

the collapsible decompression shelter capable of sheltering at least one diver while the diver is wearing a diver's suit, the collapsible decompression shelter including an inlet for receiving water within the collapsible decompression shelter, an outlet for removing water from within the collapsible decompression shelter, and the collapsible decompression shelter defining a closable opening providing access into and out of the collapsible decompression shelter when open and impeding release of the water circulating within the collapsible decompression shelter when closed;

a heat source for heating water to be received and circulated within the collapsible decompression shelter through the inlet for receiving water and the outlet for removing water;

means for transferring heated water from the means for heating the water to the inlet for receiving water within the collapsible decompression shelter; and means for moving heated water from the heat source to the collapsible decompression shelter.

2. A collapsible decompression shelter as set forth in claim 1 wherein the heat source for heating water to be received within the collapsible decompression shelter comprises at least one water cooled engine.

3. A collapsible decompression shelter as set forth in claim 1 wherein the means for moving heater water comprises at least one cooling water circulation pump of a water cooled engine.

4. A collapsible decompression shelter as set forth in claim 1 wherein the mans for transferring heater water comprises at least one flexible tube having a first end and a second end, the first end in communication with the heat source, and the second end in communication with the inlet of the collapsible decompression shelter.

5. A collapsible decompression shelter as set forth in claim 1 wherein the outlet for removing water from within the collapsible decompression shelter includes at least one pressure relief valve.

6. A collapsible decompression shelter as set forth in claim 1 wherein the closable opening comprises at least one opening in the collapsible decompression shelter, the opening having an edge margin and the edge margin comprising an elastic to bias the opening to a normally closed position.

7. A collapsible decompression shelter as set forth in claim 1 wherein at least one of the closable opening is located proximate the bottom of the collapsible decompression shelter when the collapsible decompression shelter is in use.

8. A collapsible decompression shelter as set forth in claim 1 further including at least one emergency opening.

9. A collapsible decompression shelter as set forth in claim 1 further including at least one emergency opening having a tab and groove fastener to maintain the closable opening in a normally closed condition.

10. A collapsible decompression shelter as set forth in claim 1 further including at least one emergency opening located proximate the top of the collapsible decompression shelter when the collapsible decompression shelter is in use.

11. A collapsible decompression shelter as set forth in claim 1 wherein the collapsible decompression shelter is a coverall worn by a diver.

12. A collapsible decompression shelter as set forth in claim 11 further including a support platform located so as to support the collapsible decompression shelter either while in use or while not in use.

13. A collapsible heated diver decompression shelter of flexible material comprising:

the collapsible decompression shelter capable of sheltering at least one diver, the collapsible decompression shelter including at least one inlet for receiving water within the collapsible decompression shelter, at least one outlet for removing water from within the collapsible decompression shelter, and the collapsible decompression shelter defining a closable opening providing access into and out of the collapsible decompression shelter when open and impeding release of the water circulating within the collapsible decompression shelter when closed;

a heat source for heating water to be received and circulated within the collapsible decompression shelter;

means for transferring heated water from the means for heating the water to at least one of the inlets for receiving water within the collapsible decompression shelter;

means for transferring water from within the collapsible decompression shelter back to the means for heating the water; and means for moving heated water from the heat source to the collapsible decompression shelter and returning water from the collapsible decompression shelter to the heat source.

14. A collapsible diver decompression shelter as set forth in claim 13 wherein the heat source for heating water to be received within the collapsible decompression shelter comprises at least one water cooled engine.

15. A collapsible diver decompression shelter as set forth in claim 13 wherein the means for moving heated water comprises at least one cooling water circulation pump of a water cooled engine.

16. A collapsible diver decompression shelter as set forth in claim 13 wherein the means for transferring heated water from the heat source to the collapsible decompression shelter comprises at least one flexible tube having a first end and a second end, the first end in communication with the heat source, and the second end in communication with the inlet of the collapsible decompression shelter.

17. A collapsible decompression shelter as set forth in claim 13 wherein the means for transferring heated water from the collapsible decompression shelter and returning it to the heat source is another flexible tube having a first end and a second end, the first end in communication with the outlet of the collapsible decompression shelter, and the second end in communication with the heat source.

18. A collapsible decompression shelter as set forth in claim 13 wherein the collapsible decompression shelter includes an outlet for removing water from within the collapsible decompression shelter and the outlet includes a pressure relief valve.

19. A collapsible decompression shelter as set forth in claim 13 wherein the closable opening comprises at least one opening in the collapsible decompression shelter, the opening having an edge margin and the edge margin comprising an elastic to bias the opening to a normally closed position.

20. A collapsible decompression shelter as set forth in claim 13 wherein at least one closable opening is located proximate the bottom of the collapsible decompression shelter when the collapsible decompression shelter is in use.

21. A collapsible decompression shelter as set forth in claim 13 further including at least one emergency opening.

22. A collapsible decompression shelter as set forth in claim 13 further including at least one emergency opening having a tab and groove fastener to maintain the closable opening in a normally closed condition.

23. A collapsible decompression shelter as set forth in claim 13 further including at least one emergency opening located proximate the top of the collapsible decompression shelter when the collapsible decompression shelter is in use.

24. A collapsible decompression shelter as set forth in claim 13 wherein the collapsible decompression shelter is a coverall worn by a diver.

25. A collapsible decompression shelter as set forth in claim 24 wherein the coveralls comprise a plurality of closed pockets attached to the extremities of the coveralls.

26. A collapsible decompression shelter as set forth in claim 24 wherein the coveralls comprise a hod attached to a neck portion of the coverall.

27. A collapsible decompression shelter as set forth in claim 24 wherein the coveralls comprise a closure member for enclosing the coverall around the diver.

28. A collapsible decompression shelter as set forth in claim 24 wherein the coveralls comprise a plurality of closed pockets for enclosing and thermally protecting the hands and feet of the diver.

29. A collapsible decompression shelter as set forth in claim 24 wherein the coveralls comprise a hood enclosing and thermally protecting the head of the diver.

30. A collapsible decompression shelter as set forth in claim 24 wherein the coveralls comprise a hood enclosing and thermally protecting the head of the diver, the hood including a transparent portion.

31. A collapsible decompression shelter as set forth in claim 13 further including a support platform.

* * * * *